United States Patent [19]

Sakuuchi et al.

[11] Patent Number: 4,822,016

[45] Date of Patent: Apr. 18, 1989

[54] SHEET SORTER HAVING PIVOTAL SHEET GUIDE AND DISCHARGE LINKAGE MECHANISM

[75] Inventors: Toshio Sakuuchi, Ibaraki; Kuniaki Kimura, Mito, both of Japan

[73] Assignee: Ikegami Tsushinki Co., Ltd., Tokyo, Japan

[21] Appl. No.: 92,422

[22] Filed: Sep. 3, 1987

[30] Foreign Application Priority Data

Sep. 9, 1986 [JP] Japan ..... 61-210673
Sep. 9, 1986 [JP] Japan ..... 61-210674

[51] Int. Cl.[4] ..... B65H 39/02
[52] U.S. Cl. ..... 270/58
[58] Field of Search ..... 270/52, 58; 271/287, 271/294, 295, 296

[56] References Cited

U.S. PATENT DOCUMENTS 4,265,445 5/1981 Langer ..... 271/296
4,638,922 1/1987 Johdai et al. ..... 271/296

FOREIGN PATENT DOCUMENTS 12574 1/1986 Japan ..... 270/52
2139195A 11/1984 United Kingdom .

*Primary Examiner*—Robert E. Garrett
*Assistant Examiner*—Therese M. Newholm
*Attorney, Agent, or Firm*—Parkhurst, Oliff & Berridge

[57] ABSTRACT

A sheet sorter delivers sheets introduced seriatim from a host unit such as a copier onto a plurality of removable stationary sheet receiving trays through its pivotable sheet guide and discharge mechanism having four pivotal axes. The sheet guide and discharge mechanism is pivotably supported at its one end on two fixed pivotal axes so that the mechanism can be pivotally swung up and down about the two fixed pivotal axes. At the other end of the sheet guide and discharge mechanism, which is unsupported, are disposed the other two pivotal axes and sheet discharge rollers. The swinging motion of the mechanism is achieved by a Geneva drive mechanism including a first driving motor so that the level of the sheet discharge roller is sequentially shifted to be aligned with each of the tray levels and the sheets are seriatim sorted onto the respective trays. The sorter has a second driving motor for driving the sheet discharge rollers. The axis of the sheet discharge rollers makes a circular-arc movement about one of the fixed axes and the front edges (the sheet entry side) of the trays are disposed along the locus of the circular-arc movement of the sheet discharge rollers so that the sheet discharge rollers stay juxtaposed with the front edge of the corresponding tray at each of the sheet discharge stages.

8 Claims, 5 Drawing Sheets

SHEET SORTER HAVING PIVOTAL SHEET GUIDE AND DISCHARGE LINKAGE MECHANISM

BACKGROUND OF THE INVENTION

1. Field of the Invention

The present invention relates to a sheet sorter, and more particularly to a sheet sorter which is suitably used in association with lightweight and compact photocopiers.

2. Description of the Prior Art

In a conventional sheet sorter which is used in association with photocopiers, printers or similar apparatuses, a plurality of sheet receiving trays are disposed in a closely spaced stack. When sheets are seriatim received from a host unit such as a copier through a sheet inlet of the sorter, a sheet transport or guide mechanism of the sorter selectively directs and delivers the sheets to the entrances of the separate trays and a sheet discharging means discharges the sheets onto the respective trays.

With the widespread use of small- and medium-size copiers and printers in recent years, a compact, easy-to-use and low-cost sheet sorter well suited to such copiers or printers has been positively demanded. With such a sorter, it is necessary that sheets received from the host unit be reliably and accurately discharged onto the selected trays without involving a complex sheet transport or guide mechanism.

U.S. Pat. No. 4,478,406, entitled Apparatus for Sorting Photocopies, issued to Clark R. Dubois on Oct. 23, 1984, teaches a compact sorter with an improvement in the mechanism for separating shiftable sheet receiving trays by a pair of vertically movable cams and a tiltable sheet conveyor having elastic belts bridging a sheet inlet area and a sheet discharge zone.

U.S. Pat. No. 4,580,775, entitled Sheet Sorting Apparatus, issued to Ryuhei Maruyama on Apr. 8, 1986, also teaches a compact sheet sorter including a plurality of shiftable trays arranged in a vertical array and a pair of vertically movable cams for separating the trays and making a sheet discharge zone and a tiltable sheet conveyor which bridges a sheet inlet area and the sheet discharge zone. The end of the sheet conveyor at the sheet inlet of this sorter is allowed to move slidingly.

SUMMARY OF THE INVENTION

In view of the foregoing factors and conditions which are characteristic of the prior art it is the primary object of the present invention to provide a simply constructed, low-cost, reliable compact sheet sorter which can be conveniently and easily used by general users.

It is another object of the present invention to provide a compact sheet sorter which requires low power consumption.

It is a further object of the present invention to provide a compact sheet sorter having a reliable sheet guide and discharge mechanism and problem-free sheet receiving trays.

It is still another object of the present invention to provide a compact sheet sorter which can be easily serviced.

In order to achieve the objects, the present invention provides a compact sheet sorter which has no complicated and power consuming mechanisms such as a sheet conveying mechanism or shiftable trays. The sheet sorter of the present invention comprises a pivotable sheet guide and discharge mechanism which delivers sheets introduced seriatim from a host unit such as a copier through a sheet inlet of the sorter onto a plurality of removable stationary sheet receiving trays. The sheet guide and discharge mechanism is arranged basically in a pivotable linkage system having four pivotal axes. The pivotable linkage system extends from the sheet inlet area and pivotally and consecutively reaches each of the receiving trays. The sheet guide and discharge mechanism is pivotally supported at its one end by the frame of the sorter on two fixed pivotal axes so that the mechanism can be pivotally swung up and down about the two fixed pivotal axes. The two fixed pivotal axes are disposed in the proximity of the sheet inlet of the sorter. Two other pivotal axes and sheet discharge rollers are disposed at the other end of the sheet guide and discharge mechanism. A sheet guide path is formed between the supported end and the unsupported end of the mechanism. The swinging motion of the mechanism including the sheet guide path is achieved by a first driving means including a Geneva drive mechanism so that the level of the sheet discharge rollers is sequentially shifted to be aligned with each of the tray levels and the sheets are seriatim sorted onto the respective trays. The sorter has a second driving means for driving the sheet discharge rollers.

The features of the sheet sorter of the present invention which are believed to be novel are set forth with particularity in the appended claims. Other features and many of the attendant advantages will be more readily appreciated as the same becomes better understood by reference to the following detailed description and considered in connection with the accompanying drawings in which like reference symbols designate like parts throughout the figures.

DETAILED DESCRIPTION OF PREFERRED EMBODIMENTS

Figure 1:
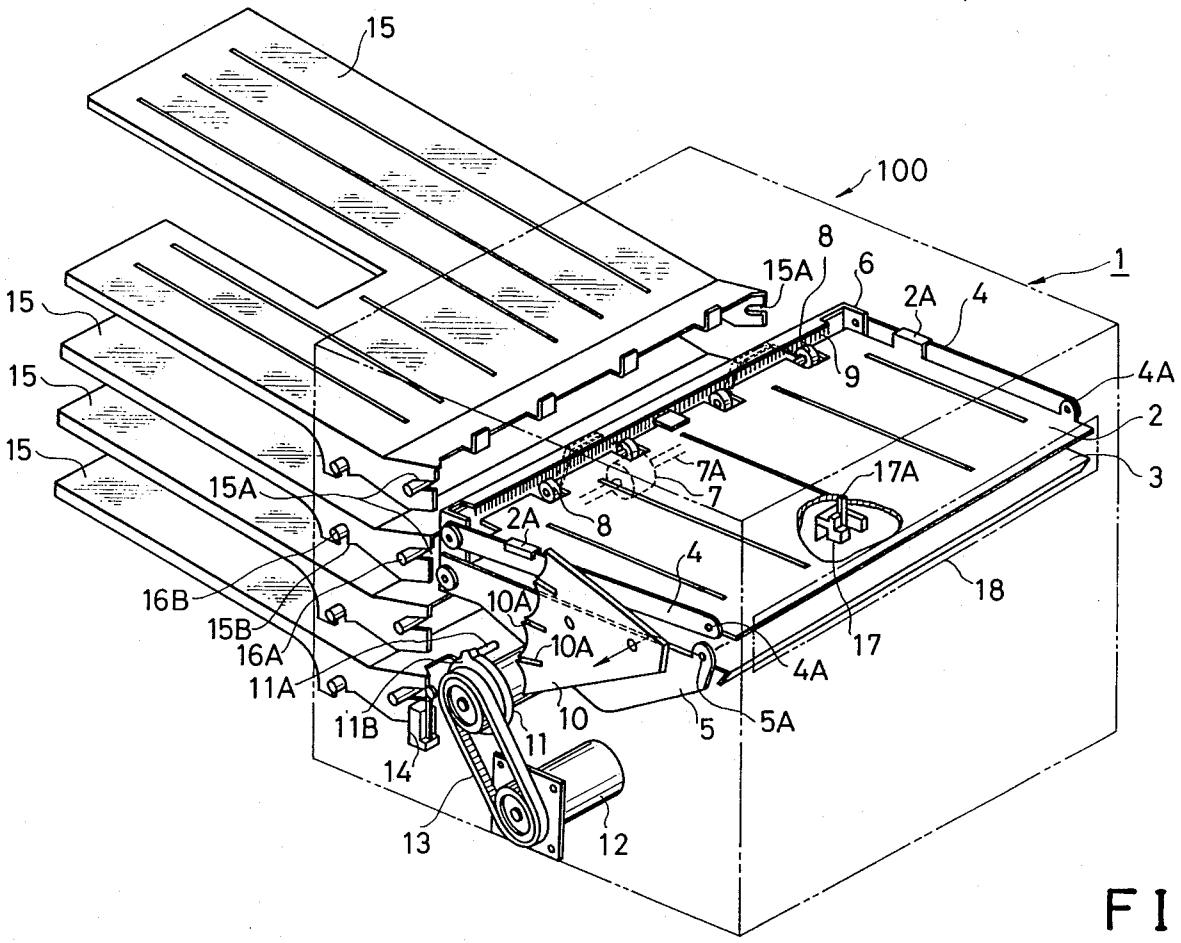
FIG. 1 is a perspective view showing major portions of a sheet sorter according to the present invention.

Referring now to the drawings there is shown in FIG. 1 a sheet sorter utilizing the present invention and generally designated by the reference numeral 100.

As shown in FIG. 1, the sheet sorter 100 has a case 1 including a frame (not shown) and a sheet inlet 18, an upper sheet guide plate 2, a lower sheet guide plate 3, a pair of arms 4 and a pair of side plates 5.

Figure 2:
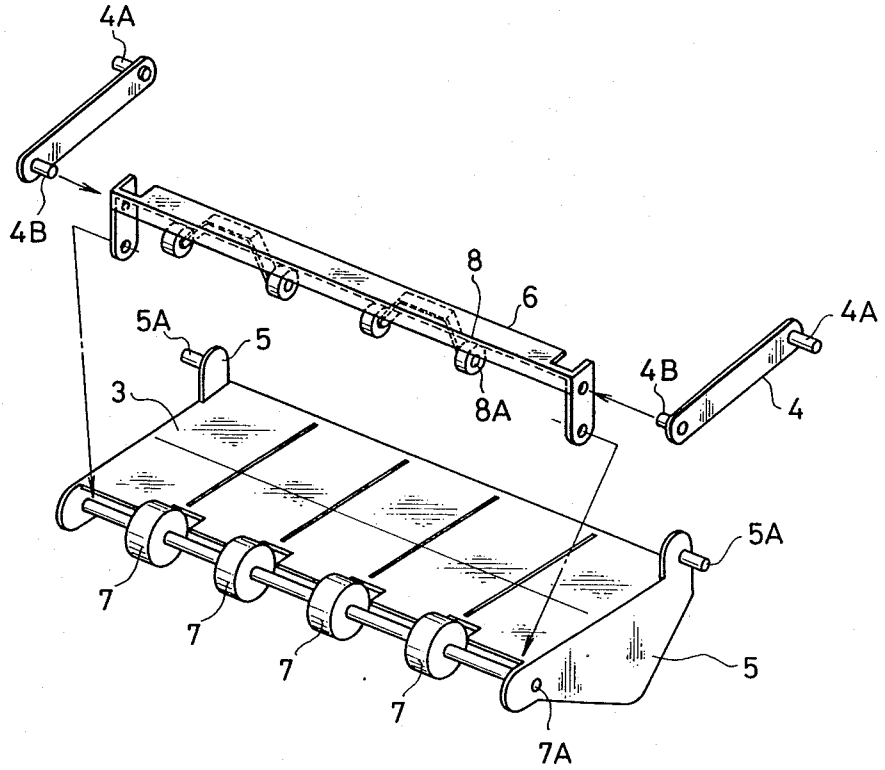
FIG. 2 is an exploded perspective view showing essential parts of a sheet guide and discharge mechanism of the sheet sorter shown in FIG. 1.

Referring to FIGS. 1 and 2, each of the arms 4 is disposed to each side of the upper sheet guide plate 2. Each of the arms 4 has a pin 4A in its first end which pivotably secures the corresponding arm 4 in the first end close to the sheet inlet 18, and the upper sheet guide plate 2, in its corresponding side in the vicinity of the sheet inlet 18, to the frame of the case 1. Each of the side plates 5 is rigidly secured to each side of the lower sheet guide plate 3. Each of the side plates 5 has a pin 5A which pivotably secures the corresponding side plate 5 in its first end closed to the sheet inlet 18, and the lower sheet guide plate 3, to the frame of the case 1.

The sheet sorter 100 also has a transversely extending coupling bracket 6, sheet discharge rollers 7, a shaft 7A on which the sheet discharge rollers 7 are fixedly mounted, idler pinch rollers 8 and a static electricity discharge brush 9. The idler pinch rollers 8 having an axis 8A are disposed generally within the space formed by the coupling bracket 6 and are resiliently secured to the bracket 6 so as to be urged against the respective sheet discharge rollers 7.

Each of the arms 4 has a pin 4B in its second end and is thereby pivotably connected to each end section of the coupling bracket 6. The pinch rollers 8 are so disposed that their axis 8a substantially coincides with the axis of the pins 4B. Each end of the shaft 7A is journaled to the corresponding end section of the coupling bracket 6 and to the second end of the corresponding side plate 5, as shown in FIG. 2. That is, the second ends of the side plates 5 are pivotably connected to the respective ends of the coupling bracket 6 on the rotational axis of the shaft 7A.

As shown in FIG. 1, the upper sheet guide plate 2 has a hook 2A on each side thereof, thereby riding on the arms 4 by the respective hooks 2A. Therefore, the upper sheet guide plate 2 may be pivotably lifted open on the pins 4A in case of sheet jamming. The static electricity discharge brush 9 is fixedly secured to the coupling bracket 6 so as to eliminate the static electricity which may be accumulated on the sheets being sorted.

Figure 3:
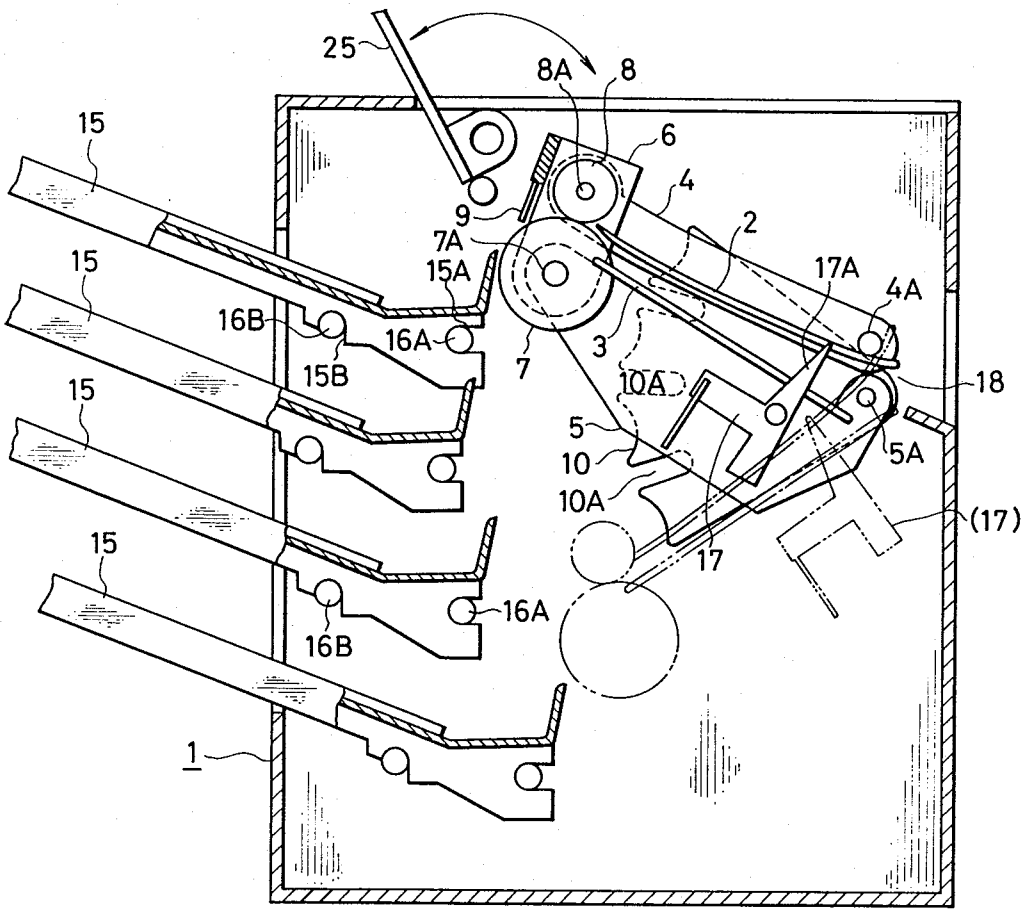
FIG. 3 is a schematic partially cutaway cross-sectional side-elevational view showing major portions of the sheet sorter.

Referring to FIGS. 1 and 3, the sheet sorter 100 further contains a palm-shaped Geneva wheel 10 having slots 10A, a Geneva cam 11 having a drive pin 11A and a switch actuating pawl 11B, a bidirectional motor 12, a drive belt 13 and a microswitch 14. The Geneva wheel 10 is fixedly secured to one of the side plates 5 so as to rotate always with the side plates 5 about the pivotal axis of the pins 5A (FIG. 2). The drive pin 11A of the Geneva cam 11 is engageable with the slots 10A of the Geneva wheel 10. (In FIG. 1, the Geneva wheel 10 is depicted loose from the side plate 5 and the drive pin 11A.) The motor 12 bidirectionally drives the Geneva cam 11 by the belt 13. One revolution of the Geneva cam 11 causes the Geneva wheel 10 to rotate by the slot-to-slot angle. Such rotation of the Geneva wheel 10 results in a rotation of the side plates 5 and the lower sheet guide plate 3 about the axis of the pins 5A. Then the axis of the sheet discharge rollers 7 and the shaft 7A makes a circular-arc movement about the axis of the pins 5A. The rotation of the side plates 5 will also cause the arms 4 and the upper sheet guide plate 2 to rotate about the axis of the pins 4A by substantially the same angle as the Geneva wheel 10 because the arms 4 are pivotably linked to the side plates 5 by the coupling bracket 6. The microswitch 14 is actuated once by the pawl 11B of the Geneva cam 11 while the Geneva cam 11 makes one revolution, whereby a signal from the microswitch 14 causes the motor 12 to be turned off after the Geneva cam 11 has completed one revolution.

In reference to FIGS. 1 and 3, the sheet sorter 100 also includes a plurality of vertically stacked stationary trays 15, each having in its sides a pair of first slots 15A and a pair of second slots 15B; and first tray holding pins 16A and second tray holding pins 16B. The trays 15 are made of resin-based material. The first tray holding pins 16A and the second tray holding pins 16B are disposed in alignment with a vertical plane on each side of the trays 15 and are fixedly secured to the frame of the case 1. Levels of the first tray holding pins 16A are coordinated with those of the corresponding second tray holding pins 16B; the first tray holding pins 16A engage with the respective first slots 15A and the second tray holding pins 16B engage with the respective second slots 15B; each of the trays 15 is supported by a pair of the first holding pins 16A and a pair of the second tray holding pins 16B so that the trays 15 are removably secured to the frame of the case 1 in an upwardly slant angle with respect to the sheet entry direction. The front edges (the sheet entry side) of the trays 15 are disposed in parallel with the shaft 7A along the locus of the circular-arc movement of the sheet discharge rollers 7 so that the sheet discharge rollers 7 stay juxtaposed with the front edge of the corresponding tray at each of the sheet discharge stages.

As shown in FIGS. 1 and 3, the sheet sorter 100 further contains a photo sensor 17 having a pivoted actuating lever 17A. The photo sensor 17 is mounted on the underside of the lower sheet guide plate 3 in its laterally mid section close to the sheet inlet 18. The tip of the pivoted actuating lever 17A of the photo sensor 17 protrudes upwardly through a slot of the lower sheet guide plate 3 so that a sheet entered through the sheet inlet 18 will push the tip of the actuating lever 17A causing the lever 17A to be tilted down and the light path (not shown) of the photo sensor to be interrupted by the lever 17A; thus the entry of the sheet is detected by the photo sensor 17.

Figure 4:
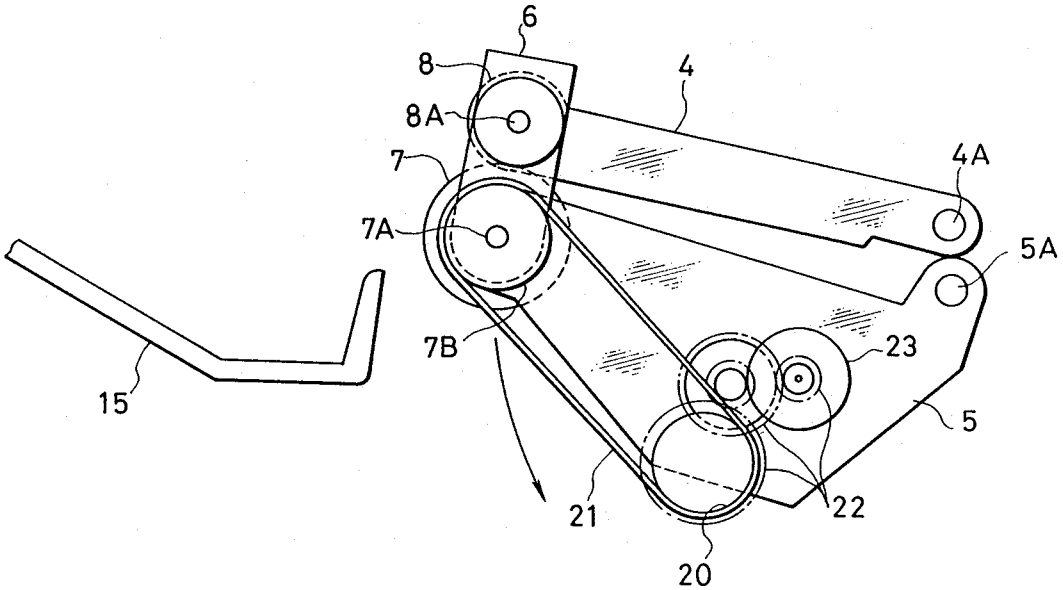
FIG. 4 is a schematic side view showing the sheet guide and discharge mechanism and a sheet discharge roller drive means of the sheet sorter.

FIG. 4 schematically shows a drive mechanism of the sheet discharge rollers 7 utilized in the sheet sorter 100. The mechanism employs a driven pulley 7B fixedly mounted on the shaft 7A, a drive pulley 20, a drive belt 21, a reduction gear train 22 and a drive motor 23. Needless to say, the discharge rollers 7 are driven by the drive motor 23 in the counterclockwise direction (as viewed in FIG. 4) through the gear train 22, the drive pulley 20, the belt 21, the driven pulley 7B and the shaft 7A. The drive pulley 20, the reduction gear train 22 and the motor 23 are secured to the corresponding side plate 5. Therefore, the motor 23 can drive the sheet discharge rollers 7 without being affected by any rotational motion of the side plates 5. Upon receiving a sheet detection signal from the photo sensor 17 (FIG. 1), a controller (not shown) of the sheet sorter 100 causes the motor 23 to be turned on and the sheet discharge rollers 7 to be rotated so that the sheet entered is nipped and pulled forward by the sheet discharge rollers 7 and the idler pinch rollers 8 and is discharged onto one of the trays 15. An O-ring belt is preferably used for the drive belt 21 because the O-ring belt allows itself to slip on the pulleys in case a sheet jamming occurs and the motor 23 is subjected to an excessive load.

Figure 5:
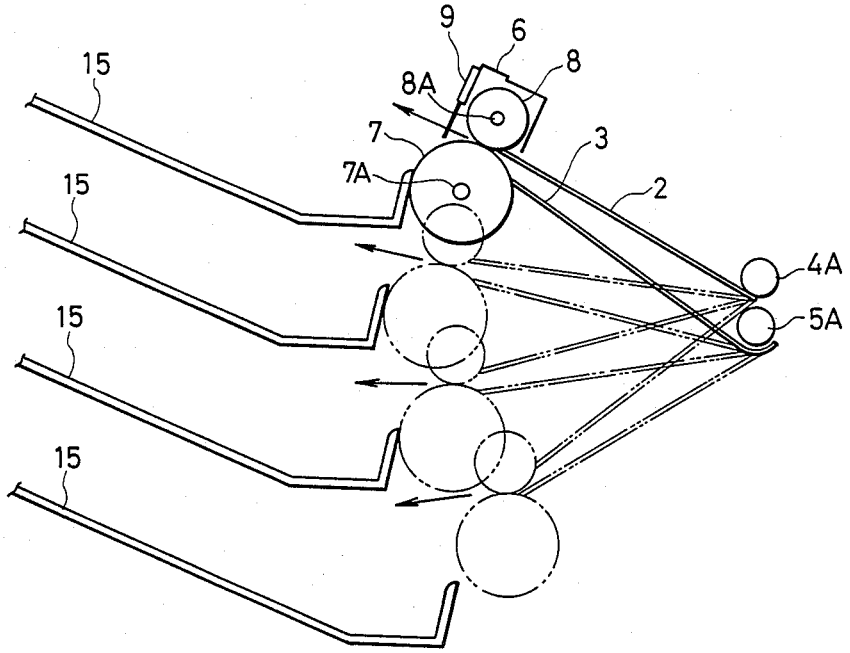
FIG. 5 is a schematic partial side view showing sheet discharge directions according to various angular positions of the sheet guide and discharge mechanism.

Referring to FIGS. 3, 4, and 5, the side plates 5 and the lower sheet guide plate 3 intermittently rotate about the axis of the pins 5A in such a manner that the level of the sheet discharge rollers 7 is aligned with the sheet entry level for each of the trays 15 upon completion of each rotational movement thereof. Because the upper sheet guide plate 2 is pivotably connected to the lower sheet guide plate 3 through the side plates 5, the coupling bracket 6, the arms 4, and the hooks 2A (FIG. 1), the upper sheet guide plate 2 follows the rotational motion of the lower sheet guide plate 3.

As indicated by arrows in FIG. 5, the sheet discharge direction at each tray stage always conforms to the common tangent to the peripheries of the sheet discharge rollers 7 and the pinch rollers 8. By properly determining the center distance between the pins 4B (FIG. 2) and the shaft 7A with respect to the center distance between the pins 4A and the pins 5A and the center distance between the pins 5A and the shaft 7A with respect to the center distance between the pins 4A and the pins 4B, the sheet discharge direction at each tray stage can be maintained within a predetermined angular range. In this embodiment, the center distance between the pins 5A and the shaft 7A is made greater than the center distance between the pins 4A and the pins 4B, whereby the axis 8A of the pinch rollers 8 comes horizontally more away from the tray than the shaft 7A when the sheet guide and discharge mechanism is substantially horizontal, as shown in FIG. 4. Such dimensional arrangement makes the average sheet discharge angle upwardly slant rather than horizontal, thereby facilitating sheet depositings on the trays. Needless to say, the sheet discharge directions at all of the tray stages can also be made identical if the aforementioned four dimensions are predetermined to form a parallelogram. In short, the sheet sorter 100 has a swingable sheet guide and discharge mechanism utilizing a four pivotal axis linkage system by which sheet discharge directions can be properly maintained.

As mentioned before, the pinch rollers 8 are disposed in such a manner that their axis 8A substantially coincides with the pivotal axis of the pins 4B. Therefore, the imaginary plane which is commonly tangent to the peripheries of the sheet discharge rollers 7 and the pinch rollers 8 is substantially perpendicular to the imaginary plane which includes the pivotal axis of the pins 4B and the axis of the shaft 7A. For convenience, the former imaginary plane will be hereinafter called "the tangential plane" and the latter imaginary plane will be called "the 4B-7A plane". The perpendicularity between the tangential plane and the 4B-7A plane will be maintained so long as the axis 8A stays in the 4B-7A plane even if the axis 8A does not coincide with the axis of the pins 4B. In this case, the line commonly included in the tangential plane and the 4B-7A plane is the contact line of the sheet discharge rollers 7 with the pinch rollers 8.

The tangential plane, of course, represents the sheet discharge direction. Therefore, the sheet discharge direction is always maintained perpendicular to the 4B-7A plane so long as the axis 8A stays in the 4B-7A plane.

Now, we will call "the 7A-5A plane" for the imaginary plane which includes the axis of the shaft 7A and the pivotal axis of the pins 5A and "the angle 4B-7A-5A" for the angle formed by the 4B-7A plane and the 7A-5A plane. Because of the fact that the swingable sheet guide and discharge mechanism of the sheet sorter 100 consists basically of a linkage system having four pivotal axes which swings up or down on the fixed pivotal axes of the pins 4A and the pins 5A, the angle 4B-7A-5A will always decrease when the mechanism swings down and the angle 4B-7A-5A will always increase when the mechanism swings up. In other words, the 4B-7A plane turns about the axis of the shaft 7A in always the opposite direction to the turning direction of the 7A-5A plane as the 7A-5A plane turns about the axis of the pins 5A.

This means that the paper discharge direction turns clockwise (as viewed in FIG. 5) when the mechanism swings down and counterclockwise when the mechanism swings up, with respect to the angular position of the 7A-5A plane, as shown in FIG. 5. This is an advantageous angle compensation effect for the sheet discharge direction. Because of such effect, the angular variation of the sheet discharge direction can be restricted within a desirable range and the sheet is not discharged at an exceedingly upward angle or downward angle, with respect to the set angle of the trays 15, when the sheet discharging takes place to a high level tray or to a low level tray, respectively. This effect substantially reduces the chance of sheet jamming in the sheet discharging operation.

In another embodiment of the invention, the pinch rollers 8 are still mounted on the coupling bracket 6 but their axis 8A is disposed off the 4B-7A plane. In this case, the angle formed by the tangential plane and the 4B-7A plane is not the right angle but is still a fixed angle. Therefore, sheet discharge angle against the 4B-7A plane is maintained constant, whereby the above-mentioned compensation to the sheet discharge direction is equally effective.

Now, the operation of the sheet sorter 100 will be explained in reference to FIGS. 1 to 5. The sheets to be sorted as seriatim delivered from a host unit (not shown) such as a copying machine to the sheet sorter 100 through the sheet inlet 18. Each of the sheets delivered to the sheet sorter 100 is advanced in the path formed between the upper and lower sheet guide plates 2 and 3 by the sheet discharge mechanism (not shown) of the host unit. The leading edge of the sheet pushes and tilts down the actuating lever 17A of the photo sensor 17. Then, as mentioned before, the entry of the sheet is detected by the photo sensor 17 whereby the photo sensor transmits a signal to the controller causing the drive motor 23 to be turned on and the sheet discharge rollers 7 to be rotated. By the time the leading edge of the sheet has reached the sheet discharge rollers 7 and the idler pinch rollers 8, the sheet discharge rollers 7 are already in rotation. Therefore, the sheet discharge rollers 7 and the idler pinch rollers 8 nip the sheet, advance and discharge it onto the receiving tray. It is for now assumed that the first sheet delivered from the host unit has been discharged onto the uppermost tray. On the other hand, as the trailing edge of the sheet passes over the actuating lever 17A of the photo sensor 17, the lever 17A reverts to the normal position; then the photo sensor 17 transmits another signal to the controller, which in turn causes the drive motor 23 to be turned off after a predetermined amount of time delay. Thus the rotation of the sheet discharge rollers 7 is stopped.

Then, the controller further causes the motor 12 to be turned on and the Geneva cam 11 to be turned by one revolution in the clockwise direction, as viewed in FIG. 1, resulting in a counterclockwise rotation of the Geneva wheel 10 by one tray stage angle because one slot-to-slot angular displacement of the Geneva wheel corresponds to the tray-to-tray distance. Accordingly, the sheet discharge rollers 7 are moved down to the position opposing the second tray from the uppermost. As mentioned before, a signal from the microswitch 14 causes the motor 12 to be turned off when the Geneva cam 11 has completed one revolution. Similarly, each of the successively entered sheets will be discharged onto each of the consecutively lower trays.

Although details are not provided, the sheet sorter 100 is additionally equipped with a pair of position sensors which can detect the sheet discharge rollers 7 when the sheet discharge rollers 7 are in their uppermost position opposing the uppermost tray and their lowermost position opposing the lowermost tray. After the first sorting cycle has been completed the second sorting cycle may be made in the order of the upwardly consecutive tray stages by reversing the rotational direction of the motor 12. The controller is so designed as to initialize the operational cycle after a given number of sheets have been sorted and a given number of operational cycles have been completed and cause the sheet discharge rollers 7 to return to the initial stand-by position which for now assumed to be the position opposing the uppermost tray. Alternatively, a sorting cycle can be started from the lowermost tray instead of the uppermost tray.

Referring to FIG. 3, the case 1 has a lid 25 which can be pivotally opened in case of sheet jamming, inspection or repair.

While the invention has been particularly shown and described with reference to a preferred embodiment thereof, it will be understood by those skilled in the art that various changes in form and details may be made therein without departing from the spirit and scope of the invention.

What is claimed is:

1. A sheet sorter comprising:

(a) a frame;

(b) a sheet inlet;

(c) a sheet guide and discharge linkage mechanism having a first end, a second end, and four parallel pivotal axes including a first pivotal axis which is positionally fixed, and a second pivotal axis which is also positionally fixed, a third pivotal axis and a fourth pivotal axis, said linkage mechanism being pivotally mounted on said frame in said first end on said first and second pivotal axes in the proximity of said sheet inlet whereby said linkage mechanism can be pivotally moved up or down, said linkage mechanism comprising:

a pair of first parallel linkage members extending from said first end to said second end, and being pivotable about said first pivotal axis;

a connecting member disposed between said pair of first parallel linkage members rigidly connecting said first parallel linkage members thereby;

a pair of second parallel linkage members extending from said first end to said second end, and being pivotable about said second pivotal axis; and a coupling member disposed in said second end and pivotally connected to said first linkage members on said third pivotal axis and to said second linkage members on said fourth pivotal axis;

(d) a sheet discharge roller rotatably mounted on said linkage mechanism in said second end in such a manner that said sheet discharge roller rotates about said third pivotal axis, whereby an axis of said sheet discharge roller makes substantially a circular-arc movement about said first pivotal axis as said linkage mechanism pivotally moves up or down;

(e) a plurality of sheet receiving trays mounted in a spaced array on said frame, said trays having respective front edges which are disposed substantially along the locus of the circular-arc movement of the axis of said sheet discharge roller;

(f) means for driving said sheet discharge roller;

(g) means for driving said linkage mechanism intermittently so that said linkage mechanism may be pivotally moved up or down and said sheet discharge roller may be consecutively aligned with each of said trays; and (h) a pinch roller rotatably mounted on said linkage mechanism in said second end in such a manner that said pinch roller rotates about said fourth pivotal axis, said pinch roller being in contact with said sheet discharge roller.

2. A sheet sorter according to claim 1, wherein said means for driving said linkage mechanism comprises:

(a) a Geneva wheel fixedly secured to either of said pair of first linkage members so as to be rotated about said first pivotal axis together with said first linkage members;

(b) a Geneva cam for driving said Geneva wheel rotatably mounted on said frame; and (c) a bidirectional motor for driving said Geneva cam mounted on said frame.

3. A sheet sorter according to claim 2, wherein said means for driving said sheet discharge roller comprises a motor which is mounted on either of said pair of first linkage members.

4. A sheet sorter according to claim 3, wherein said connecting member is of a plate-like form thereby suitably serving as a bottom sheet guide, the sheet sorter further comprising a top sheet guide plate mounted on said second parallel linkage members so as to be pivotable about said second pivotal axis whereby the sheet introduced to the sorter is guided between said connecting member and said top sheet guide plate.

5. A sheet sorter according to claim 1, wherein the dimension between said first pivotal axis and said third pivotal axis is greater than the dimension between said second pivotal axis and said fourth pivotal axis.

6. A sheet sorter according to claim 1, wherein said pinch roller is resiliently mounted on said coupling member so as to be urged against said sheet discharge roller.

7. A sheet sorter according to claim 6, wherein an imaginary plane which is commonly tangent to the peripheries of said pinch roller and said sheet discharge roller turning in always the opposite direction to the pivoting direction of said first parallel linkage members as said first parallel linkage members pivot about said first pivotal axis so that the angular variation of the sheet discharge direction, which coincides with said imaginary plane, is restricted within a desired range over the entire pivoting range of said first parallel linkage members.

8. A sheet sorter according to claim 1, wherein the dimension between said first pivotal axis and said third pivotal axis is equal to the dimension between said second pivotal axis and said fourth pivotal axis, and the dimension between said first pivotal axis and said second pivotal axis is equal to the dimension between said third pivotal axis and said fourth pivotal axis.

* * * * *